US006364181B1

(12) United States Patent
Garcia et al.

(10) Patent No.: US 6,364,181 B1
(45) Date of Patent: Apr. 2, 2002

(54) FIXING MEMBER FOR A DISPENSING DEVICE

(75) Inventors: Firmin Garcia, Evreux; Hervé Pennaneac'h, Verneuil-sur-Avre, both of (FR)

(73) Assignee: Valois S.A., Le Nebourg (FR)

( * ) Notice: Subject to any disclaimer, the term of this patent is extended or adjusted under 35 U.S.C. 154(b) by 0 days.

(21) Appl. No.: 09/647,836

(22) PCT Filed: Apr. 1, 1999

(86) PCT No.: PCT/FR99/00756

§ 371 Date: Dec. 6, 2000

§ 102(e) Date: Dec. 6, 2000

(87) PCT Pub. No.: WO99/51359

PCT Pub. Date: Oct. 14, 1999

(30) Foreign Application Priority Data

Apr. 6, 1998 (FR) ..... 98 04248

(51) Int. Cl.[7] ..... B05B 11/00
(52) U.S. Cl. ..... 222/634; 222/398
(58) Field of Search ..... 222/321.1, 321.7, 222/321.9, 398, 570, 574, 634, 385, 402.1

(56) References Cited

U.S. PATENT DOCUMENTS

| | | | | |
|---|---|---|---|---|
| 3,112,048 A | | 11/1963 | Finkenzeller | |
| 5,228,586 A | | 7/1993 | Fuchs et al. | |
| 5,234,135 A | | 8/1993 | LaFosse et al. | |
| 5,292,033 A | | 3/1994 | Gueret | |
| 5,299,703 A | * | 4/1994 | Cater | 215/274 |
| 5,370,272 A | | 12/1994 | Gueret | |
| 5,562,219 A | | 10/1996 | de Pous et al. | |
| 5,642,908 A | | 7/1997 | Mascitelli | |

FOREIGN PATENT DOCUMENTS

| | | |
|---|---|---|
| EP | 0 486 355 A | 11/1991 |
| EP | 0 704 250 A | 9/1995 |
| EP | 0 707 895 A | 4/1996 |

* cited by examiner

*Primary Examiner*—Henry C. Yuen
*Assistant Examiner*—Melvin A. Cartagena
(74) *Attorney, Agent, or Firm*—Rockey, Milnamow & Katc, Ltd.

(57) ABSTRACT

A fixing member is provided for fixing a fluid dispenser device, such as a pump or a valve, onto a tank or other container. The fixing member comprises a body provided for receiving a dispenser device and fixing the body onto the tank. The fixing member includes an external peripheral cover covering the body, at least in part. The cover comprises of teeth that are designed to bite into the body.

10 Claims, 2 Drawing Sheets

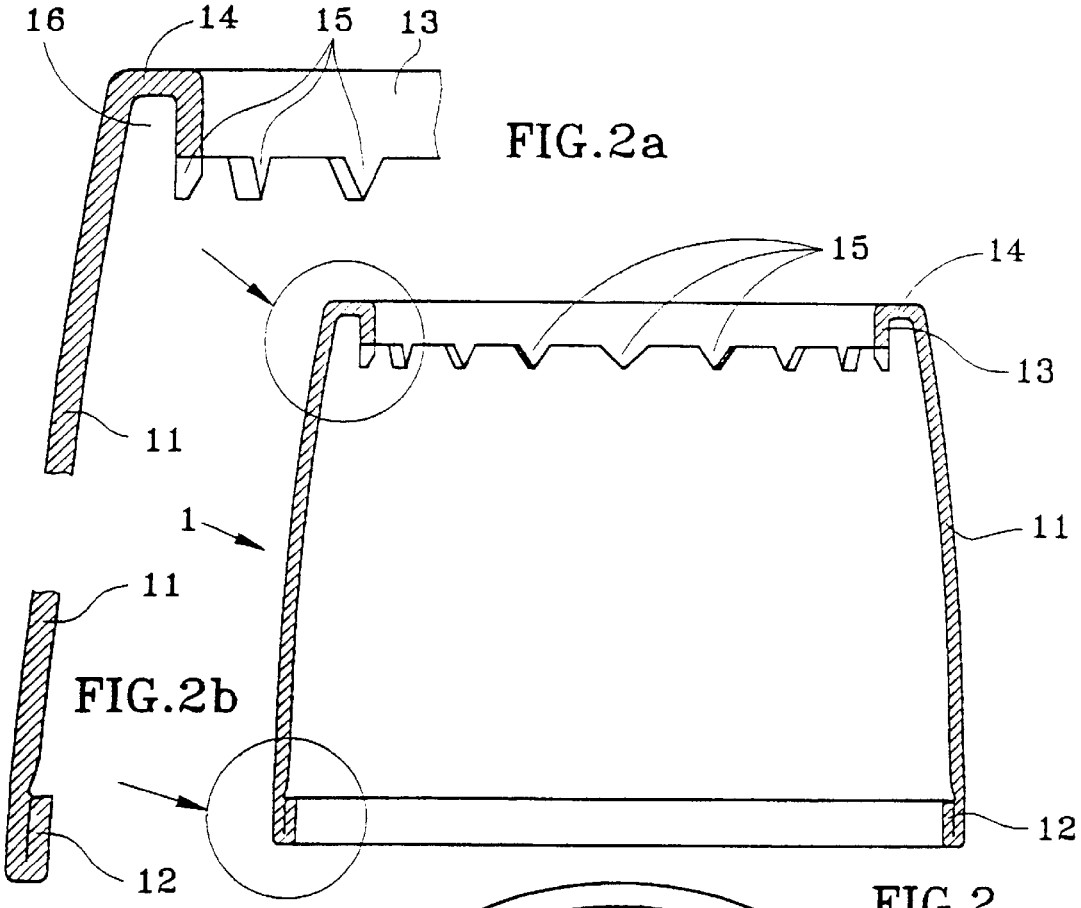
FIG.2a
FIG.2b
FIG.2
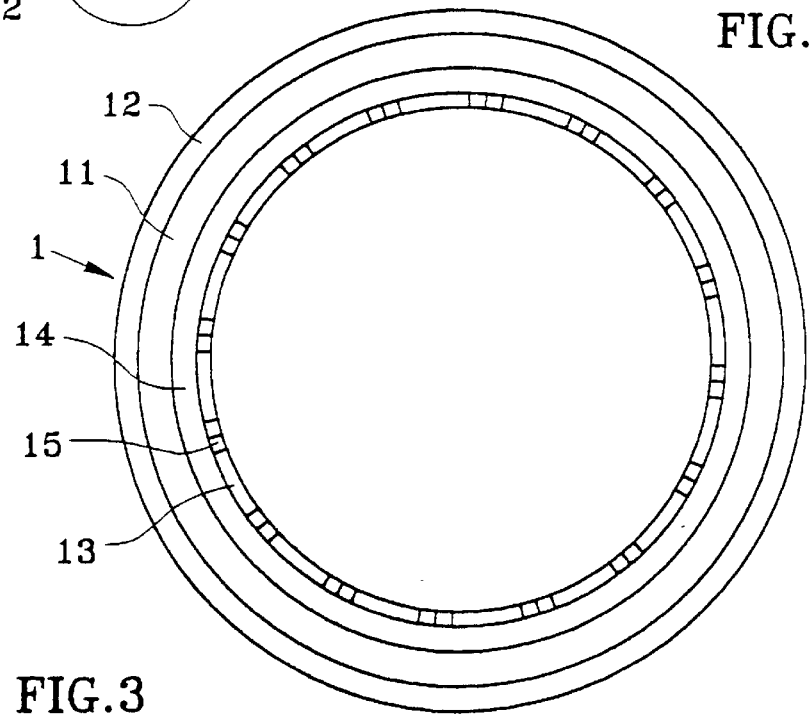
FIG.3

FIXING MEMBER FOR A DISPENSING DEVICE

This application is an application filed under 35 U.S.C. Sec. 371 as a national stage of international application PCT/FR99/00756, which was filed Apr. 1, 1999.

TECHNICAL FIELD

The present invention relates to a fixing member, such as a ring or a turret, for fixing a fluid dispenser device, such as a pump or a valve, onto the neck of a tank or other container. This type of fixing member is currently used in packaging for liquids or semi-liquids, in particular in the fields of perfumery, cosmetics, and pharmaceuticals. The fixing member, which serves to mount the pump or the valve on the tank containing the substance to be dispensed, generally comprises a body provided with generally snap-fastenable receiving means for receiving the pump or the valve, and fixing means that are screwed or crimped onto the neck of the tank.

In the case of a fixing ring, for example, the ring extends upwards from the neck of the tank and thus covers the pump or the valve. For reasons of appearance, the ring extends at least up to the bottom end of the push-button when the pump or the valve is at rest. The ring thus forms an attractive junction between the tank and the push-button which is pressed in order to actuate the dispenser device.

In some fields, and more particularly in the fields of perfumery and cosmetics, it is important for the dispenser as a whole to be attractive in appearance. Consequently, it is common to cover the ring made of molded material with a cover that is generally made of metal. The outside wall of the ring is generally cylindrical and the cover which covers it is thus in the shape of a simple cylinder that is force fitted on the ring. The cover thus remains fixed on the ring merely by the friction existing therebetween. Document U.S. Pat. No. 5,234,135 describes a dispenser, by the same inventor, comprising such a covered ring.

However, that cylindrical force-fitting technique cannot be used when the ring or the cover are not perfectly cylindrical.

In addition, a cover fitted in that way is not prevented from turning, which can be a problem.

For example, document U.S. Pat. No. 5,228,586 describes a dispenser in which a hoop is fixed onto a crimping ring by means of a top shoulder and a bottom bead which sandwich the ring respectively from above and below. The hoop is thus held on the ring while being able to rotate. It should be noted that that document does not relate to a cover, but to an indexing hoop.

SUMMARY OF THE INVENTION

The object of the present invention is to be able to fix a cover, even a non-cylindrical cover, onto a fixing member, which can itself also be non-cylindrical.

To do this, the present invention provides a fixing member for fixing a fluid dispenser device, such as a pump or a valve, onto a tank, said fixing member comprising a body provided with receiving means for receiving a dispenser device and fixing means for fixing said body onto the tank, and an external peripheral cover covering said body, at least in part, said cover comprising fastening means co-operating with said body, said fastening means comprising teeth that are designed to bite into the body.

The fastening means advantageously comprises an inwardly-directed peripheral rim defining an annular internal housing receiving one end of a sleeve formed by said body.

The teeth are preferably provided at the bottom of the rim.

Furthermore, the cover can be provided with retaining means co-operating with said body, the retaining means optionally comprising at least one internal projection co-operating, by snap-fastening, with said body.

In an embodiment, the internal projection is formed by inwardly folding the peripheral end of the cover onto itself.

In addition, the body is provided with snap-fastening means co-operating with the retaining means of the cover.

In an embodiment, the snap-fastening means comprise a plurality of resilient snap-fastening tabs.

In a variant, the snap-fastening means comprise a resilient peripheral snap-fastening collar.

In an embodiment of pleasing appearance, it is possible for the cover to be bullet-shaped in vertical section.

The fastening means and the retaining means are provided on the cover respectively at the top end and at the bottom end of the cover so that the cover is subjected to tension between its two ends.

BRIEF DESCRIPTION OF THE DRAWINGS

The invention is described below in greater detail with reference to the accompanying drawings giving an embodiment of the present invention, by way of non-limiting example.

In the drawings:

FIG. 2 is a section view through a cover of the invention;

FIGS. 2*a* and 2*b* are enlarged views respectively of the fastening means and of the retaining means; and FIG. 3 is a view from below of the cover shown in FIG. 2.

DETAILED DESCRIPTION OF THE PREFERRED EMBODIMENT

Figure 1:
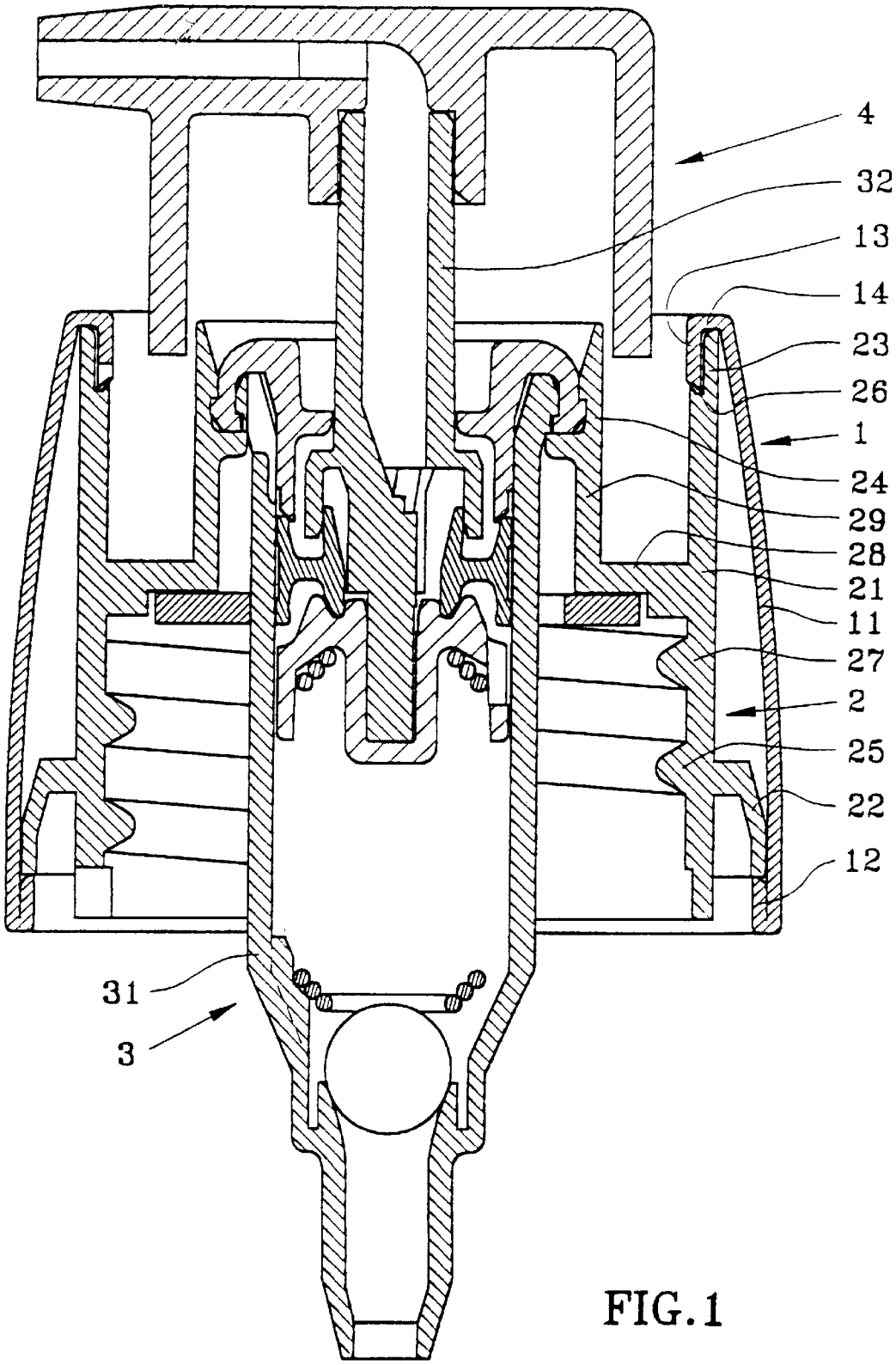
FIG. 1 is a cross-section view through a pump fitted with a fixing member of the invention.

The example in FIG. 1 shows a pump 3 surmounted by a push-button 4. Naturally, it is quite possible to replace the pump 3 with a valve. Since the internal structure of the pump 3 is not critical to the present invention it is not described at all. The only portion involved in the present invention is the body 31 of the pump. The pump 3 is fitted with a fixing member 2 which is in the shape of a ring. The pump 3 thus fitted with its ring is ready to be mounted on the neck of a tank (not shown). The ring is formed of a body 2 which, in conventional manner, comprises both receiving means 26 which receive the top end of the pump body as a forced snap-fit, and fixing means 25, in this case in the form of an internal thread designed to co-operate with a corresponding thread provided on the neck of a tank (not shown). Naturally, fixing by crimping can be envisaged instead of the internal thread 25. In greater detail, the body 2 of the ring is, overall, in the shape of a cylinder which, in its bottom portion, defines a sleeve 27 that is provided on its inside with an internal thread 25, and which, in its top portion, defines a sleeve 21 which projects upwards and terminates by a top peripheral end 23. At the junction between the sleeves 21 and 27, the ring forms an annular collar 28 which extends inwards. The collar 28 is extended along its inside periphery by a sleeve 29 which defines the snap-fastening receiving means 24 for receiving the top end of the pump body 31.

The design of such a ring 2 is entirely conventional.

However, in the invention, the ring 2 forms an annular peripheral edge 26 in the vicinity of the end 23 of the sleeve 21. As can be seen in FIG. 1, the annular peripheral edge 26 is made by the wall of the sleeve 21 thinning at the top end 23. In addition, at the bottom end of the sleeve 27, the ring 2 is provided with tabs that are distributed along the periphery or with a peripheral resilient collar 22 which projects outwards. The tabs or the collar interrupt the perfectly cylindrical appearance of the ring 2 so that its overall shape is now conical or bullet-shaped.

For the reasons of appearance described above, the ring 2 includes a cover 1, preferably made of metal, which covers the body of the ring. As can be seen in FIGS. 1 and 2, the cover is substantially bullet-shaped in cross section. To enable the cover 1 to be fixed onto the body of the ring, fastening means are provided which co-operate with the body.

In the embodiment shown in FIG. 1, the fastening means are situated at the top peripheral end of the cover 1 in the form of a peripheral rim 13 connected to the body 11 of the cover by an annular connection flange 14. The rim 13 co-operates with the top end of the body 11 of the cover 1 to form an annular internal housing 16 (FIG. 2*a*) in which the top end 23 of the sleeve 21 is engaged.

In the invention, the rim 13 is provided with teeth 15 that are downwardly directed inside the cover 1. The teeth 15 are designed to bite into the edge 26 formed by the sleeve 21 in the vicinity of its end 23. By making the cover 1 of metal and the body of the ring 2 of a plastics material, good anchoring is ensured of the teeth 15 in the edge 24. Implanting the teeth 15 in the edge 24 prevents any possibility of the cover rotating on the body of the ring.

In a variant, or in combination with the teeth, the housing 16 can be made so that the end 23 of the sleeve 21 can be engaged inside said housing 16 by force in such a manner as to wedge the annular end 23 therein. This is possible by making the housing 16 slightly narrower than the thickness of the end 23 of the sleeve 21. The annular peripheral rim 13 which thus forms an insertion housing 16 enables the cover to be fastened on the body of the ring.

In order to ensure that the cover is positioned stably, the tabs or the collar 22 of the ring are in contact with the internal wall of the body 11 of the cover. The tabs or the collar thus serve as means for guiding and holding the bottom end of the cover 1 in position.

In a preferred embodiment, the bottom end of the body 11 of the cover 1 is provided with retaining means in the form of one or a plurality of internal projections which co-operate with the body of the ring. The internal projection(s) can be of any shape providing they project inwards, forming an upwardly-directed shoulder. In a practical embodiment, given that the cover is made of metal, the retaining means can be formed by inwardly folding the bottom peripheral end of the cover onto itself, as can be seen in FIGS. 1, 2, and 2*b*. The bottom end of the cover 1 can thus co-operate, by snap-fastening, with the tabs or the collar formed by the body of the ring, as can be seen in FIG. 1. The free ends of the tabs 22 or the peripheral free end of the collar 22 come into engagement with the shoulder formed by the fold 12 of the cover 1. Because the ring 2 is made of plastic material, the tabs or the collar 22 have a certain amount of elasticity, thereby enabling the manufacturing tolerances of the cover 1 to be compensated.

Although the fastening means provided at the top end of the cover 1 are sufficient to ensure that said cover is held in position in a stable and secure manner, the addition of retaining means at the bottom end of the cover, enabling said cover to be snap-fastened, ensure that the cover 1 is held under tension between its two ends, thereby further contributing to the cover being fixed in a stable manner.

What is claimed is:

1. A fixing member for fixing a fluid dispenser device onto a tank, said fixing member comprising:

a body having receiving means for receiving a dispenser device and fixing means for fixing said body onto the tank, and an external peripheral cover covering said body at least in part, said cover having fastening means co-operating with said body, wherein said fastening means comprise teeth which bite into said body to prevent said cover from turning on said body;

and wherein said fluid dispenser device is a pump or a valve.

2. The fixing member of claim 1, wherein said fastening means comprise an inwardly-directed peripheral rim defining an annular internal housing receiving one end of a sleeve formed by said body.

3. The fixing member of claim 2 wherein said teeth are at the bottom of said rim.

4. The fixing member of claim 1, in which said cover has retaining means co-operating with said body, said retaining means comprising at least one internal projection co-operating, by snap-fastening, with said body.

5. The fixing member of claim 4, wherein said cover has a peripheral end and wherein said internal projection is formed by inwardly folding the peripheral end of said cover onto itself.

6. The fixing member of claim 4, wherein said body is provided with snap-fastening means co-operating with said retaining means of said cover.

7. The fixing member of claim 6, wherein said snap-fastening means comprise a plurality of resilient snap-fastening tabs.

8. The fixing member of claim 6, in which the snap-fastening means comprise a resilient peripheral snap-fastening collar.

9. The fixing member of claim 1 wherein said cover is bullet-shaped in vertical section.

10. The fixing member of claim 4 wherein said cover has a top end and a bottom end, and wherein said fastening means are situated at the top end of said cover and said retaining means are situated at the bottom end of said cover so that said cover is subjected to tension between said top end and said bottom end.

* * * * *